US005623134A

United States Patent [19]

Hayakawa

[11] Patent Number: 5,623,134

[45] Date of Patent: Apr. 22, 1997

[54] SWITCH WITH PIVOTING CONTROL MEMBER MOUNTED ON SLIDER

[75] Inventor: Hiroshi Hayakawa, Furukawa, Japan

[73] Assignee: Alps Electric Co., Ltd., Tokyo, Japan

[21] Appl. No.: 404,790

[22] Filed: Mar. 15, 1995

[30] Foreign Application Priority Data

Mar. 29, 1994 [JP] Japan ..... 6-083874

[51] Int. Cl.[6] ..... H01H 25/00

[52] U.S. Cl. ..... 200/5 R; 200/4; 200/16 C

[58] Field of Search ..... 200/4, 5 R, 5 A, 200/6 R, 6 A, 16 R, 16 A, 16 C, 16 D, 17 R, 18, 449, 451, 511, 512, 517, 520, 537, 541, 547, 549, 550, 551, 553, 558, 562, 563, 332, 335, 339

[56] References Cited

U.S. PATENT DOCUMENTS

| | | | |
|---|---|---|---|
| 3,604,863 | 9/1971 | Schink | 200/16 R |
| 3,670,117 | 6/1972 | Yancey | 200/16 C |
| 4,107,499 | 8/1978 | Weidler | 200/153 LA |
| 4,871,885 | 10/1989 | Kamada | 200/5 R |
| 4,918,264 | 4/1990 | Yamamoto et al. | 200/5 R |
| 5,414,231 | 5/1995 | Sato et al. | 200/1 R |

FOREIGN PATENT DOCUMENTS 6-15229 2/1994 Japan .

*Primary Examiner*—Michael L. Gellner
*Assistant Examiner*—Michael A. Friedhofer
*Attorney, Agent, or Firm*—Guy W. Shoup; Patrick T. Bever

[57] ABSTRACT

A switch for preventing unintentional actuation of, for example, a door lock in an automobile. The switch includes a slider and a control lever pivotally mounted on the slider. When the slider is in a neutral position, a guide member located in a housing of the switch abuts a protrusion of the control lever such that pivoting of the control lever is prevented, thereby preventing unintentional actuation of the door lock. To actuate the switch, the slider is moved to a second position wherein the protrusion of the control lever is not blocked by the guide member, and subsequent pivoting of the control member causes the protrusion to push a movable contact into a fixed contact of the switch. A ball is biased into a groove formed in the slider to provide a click sensation when the slider is moved from the neutral position to the second position.

8 Claims, 5 Drawing Sheets

SWITCH WITH PIVOTING CONTROL MEMBER MOUNTED ON SLIDER

BACKGROUND OF THE INVENTION

1. Field of the Invention

The present invention relates to a switch apparatus characterized by its "seesaw movement" and, more particularly, to an automotive door lock switch which is mounted on a motor car or the like and which is provided with a mechanism for preventing unintentional or accidental operation.

2. Description of the Related Art

A "seesaw-type" switch is extensively used as a switch or the like for turning ON or OFF power supplied to a motor for driving a component because it survives large currents. In the seesaw-type switch, a moving contactor is rocked around a supporting point to make or break contact between the moving contactor and a fixed contact. A switch apparatus designed to operate a switch by rocking a control lever, is employed, for example, as a door lock switch for a motor vehicle.

FIG. 8 shows such a switch apparatus in actual use as the door lock switch for a motor vehicle. This type of a door lock switch 100 and a power window switch 200 sharing the same construction with the door lock switch 100 are disposed close to each other on an armrest 90 of a driver's seat.

The door lock switch 100 is located at front left of the driver's seat. The knob of the door lock switch 100 is pressed to lock or unlock the door. The power window switch 200 is located behind the door lock switch 100; it is comprised of a total of four switches, two pairs arranged in two rows, for opening and closing the right and left windows of the front seats and the right and left windows of the rear seats, respectively.

FIG. 9 is a schematic perspective view illustrative of the construction of the switch apparatus. A pair of opposing outer side lugs 101*a* of a shallow cylindrical case 101 with a bottom extends upward, and a control lever 105 is rotatably mounted with a shaft 102 as the center thereof between the side plates 101*a*. A knob 103 is mounted on the top of the control lever 105. The control lever 105 is forked and provided with four moving contactors at the bottom thereof. The control lever 105 is further provided with mounting holes in the bottom surface thereof, driving rods being housed elastically in the mounting holes through springs.

The bottom surface of the case 101 has first fixed contacts 110*a*, 110*b* and second fixed contacts 111*a*, 111*b* which are arranged in parallel. Supporting plates are fixed on the bottom surface of the case 101 approximately at the middle between the first fixed contacts 110*a* and 110*b*. Provided on the supporting plates are moving contactors 108*a* and 108*b* which are made of curved metallic band-shaped plates.

In the conventional switch apparatus, when the control lever 103 is in the neutral position, the moving contactor 108*a*, which is pressed by the driving rod, is in contact with the fixed contact 110*b*. Under such a condition, when the control lever 103 is turned clockwise, the driving rod slides on the slide surface. The sliding resistance changes and therefore a click is felt at some midpoint during the slide, and immediately after the click, the moving contactor 108*a* is pressed by the driving rod and rotated to come in contact with the fixed contact 110*b*, thus accomplishing the changeover of the switch. The driving rod also moves on the moving contact toward the fixed contact as the control lever 103 rotates, but the moving contactor remains stationary.

Conversely, when the control lever 103 is turned counterclockwise from the neutral position mentioned above, the driving rod slides on the slide surface. A click is felt when the driving rod reaches the clicking point, and immediately after the click, the moving contactor 108*a* is pressed by the driving rod and rotated to come in contact with the fixed contact 110*a*, thus accomplishing the changeover of the switch. The driving rod also moves on the moving contactor toward the fixed contact as the control lever rotates, but the moving contactor remains stationary. The conventional switch apparatus stated above can be applied, for example, to a door lock switch for a motor vehicle.

Such a door lock switch according to the prior art is generally disposed with a power window switch side by side on an armrest of the driver's seat, and there is a danger that the door lock switch is unintentionally operated. Especially because the door lock switch is located near a power window switch and often looks alike, there is a danger that a driver unintentionally presses the door lock switch instead of the power window switch, thus releasing the door lock against his will. This often happens especially when the driver has to take a glance at switches and press the intended switch when he intends to open a window while driving . Likewise, there is a danger that a driver accidentally presses the power window switch for closing the window and gets his fingers caught by the window when he intended to release the door lock to get out of the car. Such accidental or unintended switch operation may develop into a serious accident and generate an extremely dangerous condition.

Even if the driver does not commit such a mistake in operating the switches, his fingers may accidentally touch the door lock switch, causing the door lock switch to operate when it should not, leading to an extremely dangerous condition.

SUMMARY OF THE INVENTION

The present invention has been made with a view toward solving the above problem and it is an object of the present invention to provide an automotive door lock switch for preventing unintentional or accidental operation by making it a two-step-operation switch wherein a slider, on which a control lever is mounted, is slid from the neutral position of the slider located on a case guide provided in the case until it reaches a point where the moving contact can be pressed by one end of the control lever.

To this end, according to one aspect of the present invention, there is provided an automotive door lock switch comprising: a case provided with an opening; a slider housed in the case; a control lever which is rotatably supported by the slider; a case guide which is provided in the case and the slider thereof slides in accordance with the movement of the control lever; and a moving contact which presses a fixed contact in accordance with the movement of the control lever.

According to another aspect of the present invention, there is provided an on-car door lock switch comprising: a knob mounted on one end of the control lever; a projection which is provided on the other end of the control lever and which indirectly presses the moving contact; holes which are made at the four corners of the case guide; and a cam which is installed jutting out of the holes to transmit electrical connection changeover motion; wherein the slider is allowed to slide along the case guide until the projection comes in contact with the top of the cam, then the moving contact made of a rubber sheet is pressed against the fixed contact as the control lever is operated to press the cam.

According to still another aspect of the present invention, there is provided an on-car door lock switch wherein the fixed contact is formed on a printed circuit board which is mounted on the outer frame of the case and the moving contact is formed so that it juts out in approximately a cone shape on a rubber sheet which covers the printed circuit board.

In such an automotive door lock switch having the construction described above, when the knob is pressed, the slider slides along the case guide and moves from the neutral position of the case guide to the point where the cam can be pressed by one end of the control lever, so that the moving contact is pressed via the cam, thereby causing the moving contact to be electrically connected to the fixed contact.

DESCRIPTION OF THE PREFERRED EMBODIMENTS

An embodiment of the automotive door lock switch according to the present invention will be described with reference to FIG. 1 and FIG. 2.

Figure 1:
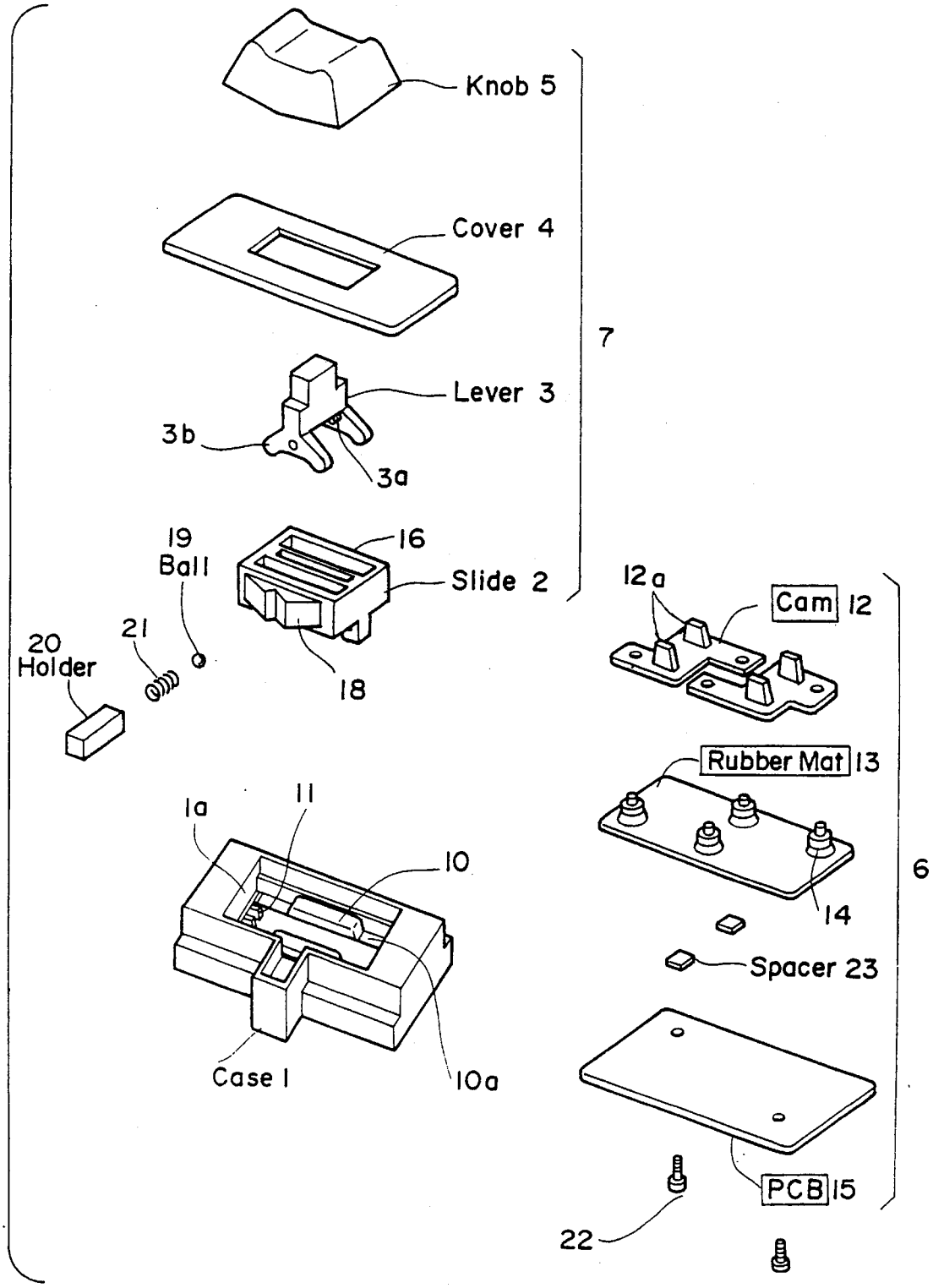
FIG. 1 is an exploded perspective view showing an embodiment wherein an automotive door lock switch according to the present invention is applied.
Figure 2:
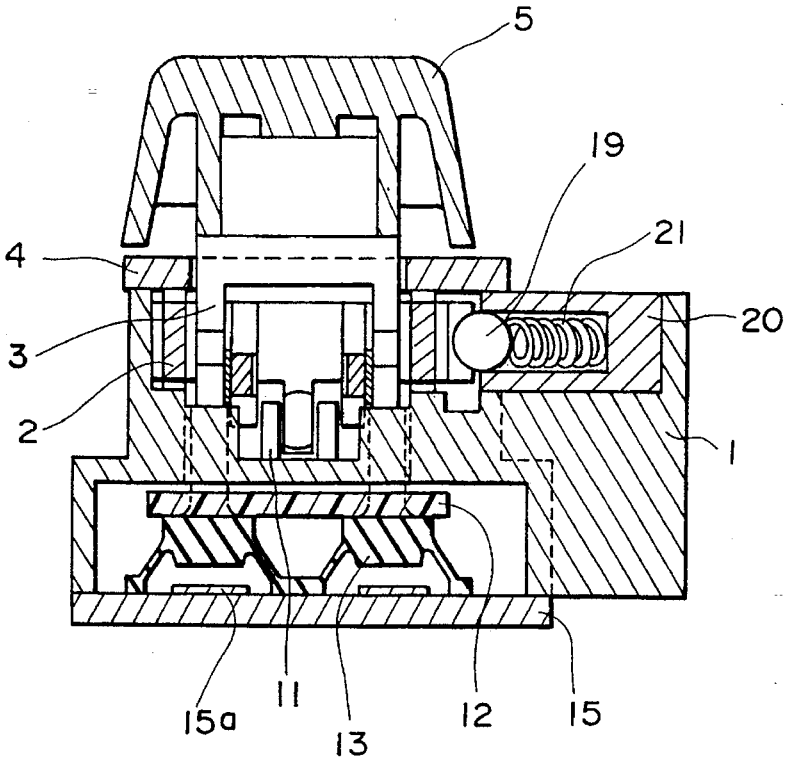
FIG. 2 is a side cross-sectional view showing a section in the vicinity of a lever shaft of the automotive door lock switch of the embodiment in FIG. 1 which has been assembled.

As shown in FIG. 1, in the automotive door lock switch according to the present invention, a slider 2 and a part of a lever 3 are housed in a case 1 provided with an opening 1*a*. One end of the lever 3 juts out from a cover 4 which covers the opening 1*a* in the case 1, and a control knob 5 is mounted on one end of the lever 3 which juts out. Further, a case guide 10 is provided to partition the interior of the case 1 into a contact operating section 6, which is composed of a moving contact and a fixed contact to be discussed later, and a driving section 7 which constitutes a switch.

The case guide 10 is equipped with a plurality of lugs 11 for providing directional restrictions, the lugs 11 being arranged in a beltlike shape. The slider 2, which engages with the lugs 11, is movably installed in the case 1. The four corners of the case guide 10 have notched holes 10*a* wherein a part of a cam 12, which moves up and down as the lever 3 is operated, is disposed. When the cam 12 moves down, a moving contact 14 in the rubber mat 13 provided under the case guide 10 is electrically connected with a fixed contact 15*a* which is located on a printed circuit board 15 provided under the case 1.

The slider 2 has two slots 16 through which the other end of the lever 3 passes. Two shaft holes 17 (shown in FIG. 3) for supporting the lever 3 are formed between the slots 16. An outer wall of the slider 2 has two projections 18 between which a ball 19 is provided. As shown in FIG. 2, the outer frame of the case 1 has a holder 20, which is mounted without any clearance to press the ball 19 against the two projections via a spring 21.

The lever 3 further has two shafts 3*a* which are rotatably inserted in the shaft holes 17, projections 3*b* being formed near the shafts 3*a* on the opposite side from the section where the knob is mounted. The cam 12 has lugs 12*a* which jut out from the holes 10*a* at the four corners of the case guide 10.

A rubber sheet, namely, a rubber mat 13, which has moving contacts 14 via spacers 23, is placed on a printed circuit board 15 installed on the bottom of the case 1 with screws 22. The moving contacts 14 are shaped approximately like cones and the tops thereof are composed of conductive members such as carbon members. The cam 12, which efficiently transmits the pressure applied by the lever 3 to the rubber mat 13, is disposed between the rubber mat 13 and the case 1.

The operation of the embodiment of the automotive door lock switch according to the present invention will now be described in conjunction with FIG. 3 through FIG. 5.

Figure 3:
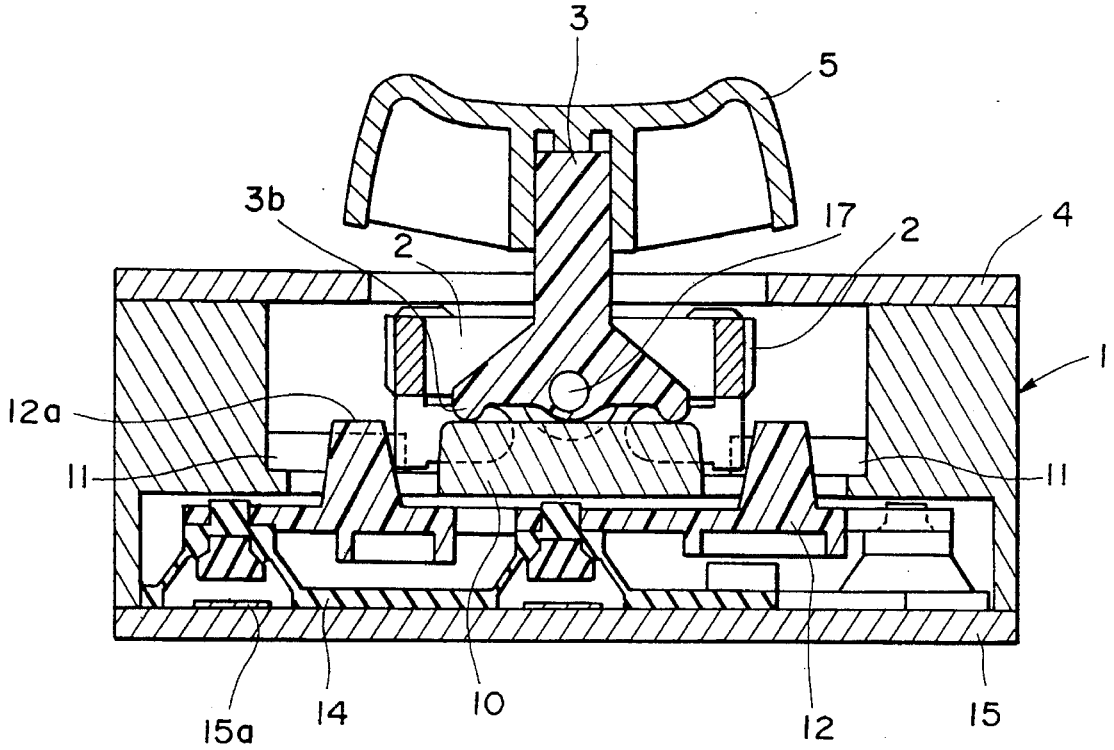
FIG. 3 is a front cross-sectional view of a section in the vicinity of a contact when the automotive door lock switch of the embodiment in FIG. 1 is in a neutral position.

As illustrated in FIG. 3, with the slider 2 set in the neutral position in the case, the knob 5 is pushed down. The pressure applied to the knob 5 produces a force which causes the lever 3 to slightly tilt with respect to the direction in which the knob 5 has been pushed. The movement of the lever 3, however, is prevented because the projections 3*b* which form one end of the lever 3 come in contact with the case guide 10.

Figure 4:
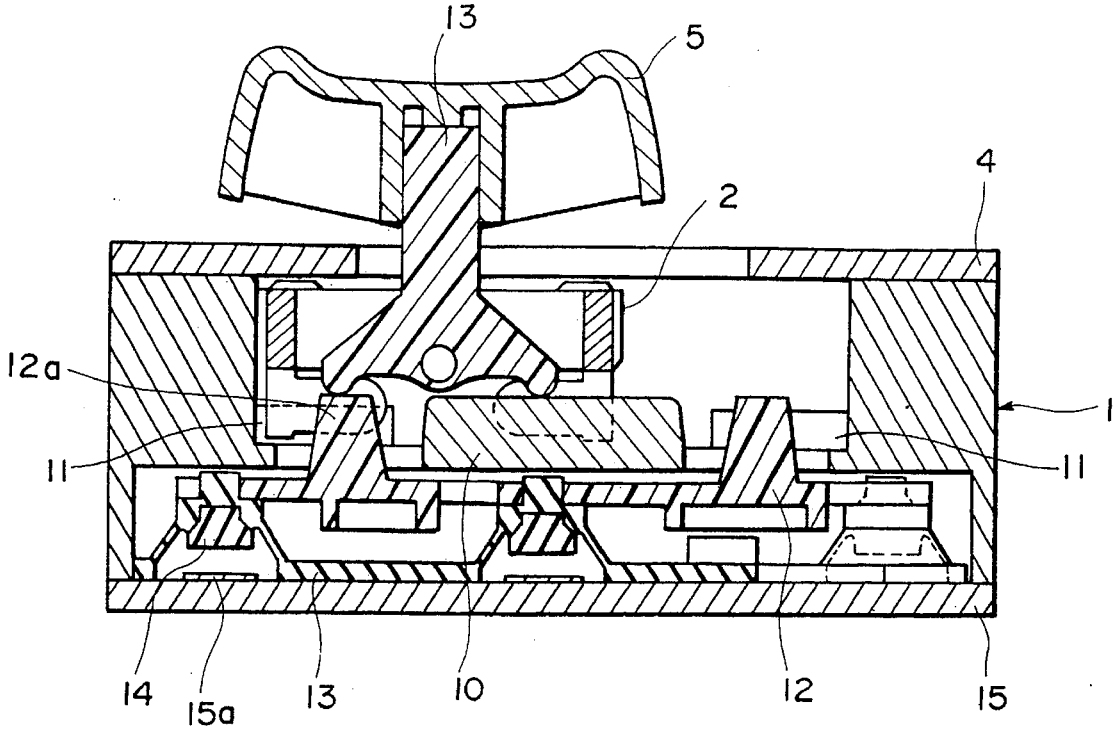
FIG. 4 is a front cross-sectional view of a section in the vicinity of the contact when the automotive door lock switch of the embodiment in FIG. 1 has been slid.

In the next step, as illustrated in FIG. 4, the finger is placed on the top of the knob 5 to push the knob 5 so that the slider 2 is moved in one direction along the case guide 10. The slider 2 moves along the inner wall of the case so that a click is felt through the ball 19 held between the two projections 18, then the projections 3*b* of the lever 3 come in contact with the lugs 12*a* of the cam 12 which are located in the holes 10*a* of the case guide 10.

Figure 5:
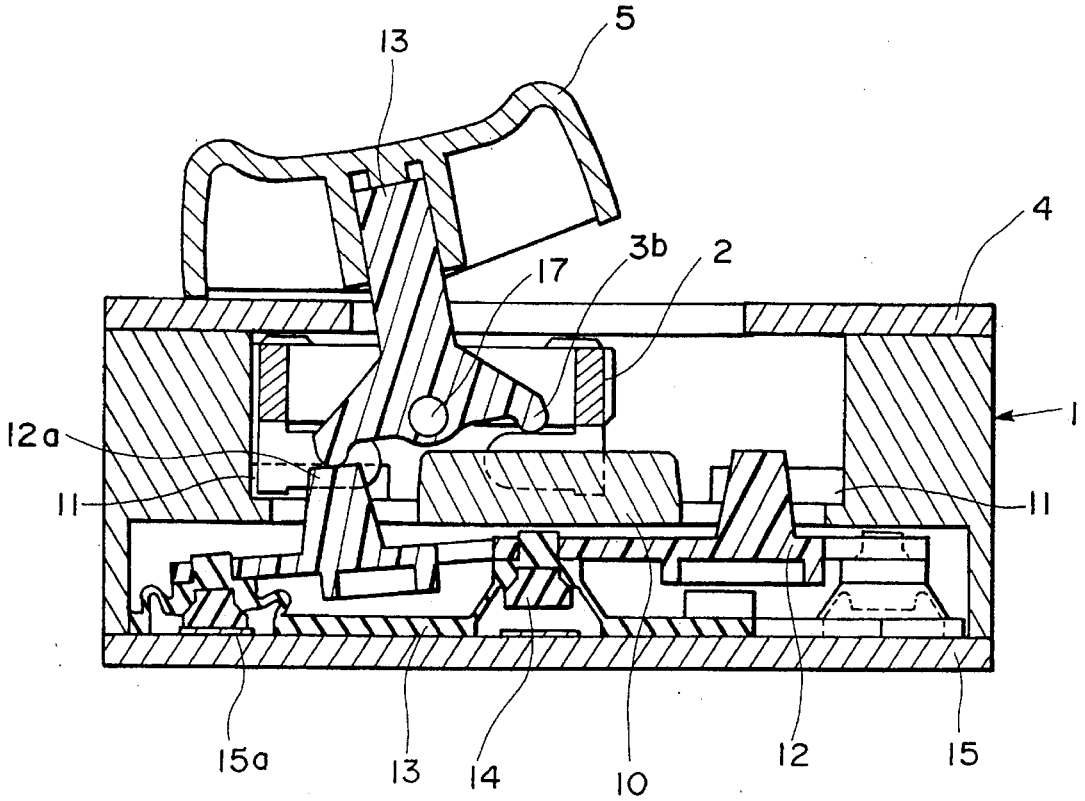
FIG. 5 is a front cross-sectional view of a section in the vicinity of the contact when the automotive door lock switch of the embodiment in FIG. 1 has been seesawed.

As shown in FIG. 5, when the knob 5 is further pushed down with the projections 3*b* of the lever 3 kept in contact with the lugs 12*a* of the cam 12, the approximately conical tops of the rubber mat 13 disposed under the lugs 12*a* are deformed and crushed downward. This causes the moving contacts 14 of the rubber mat 13 to be brought in contact with the fixed contacts 15*a* of the printed circuit board 15. Thus, the switch is turned ON and the circuit is brought into conduction, thereby locking the door.

The moment the knob 5 is released, the knob 5 goes back into the state shown in FIG. 4 due to the spring resetting force which is not illustrated.

Another push on the knob 5 by the finger causes the lever 3 to turn and the projection 3*b* to press the lug 12*a* of the cam 12. The approximately conical tops of the rubber mat 13 disposed under the lugs 12*a* are deformed and crushed downward. This causes the moving contact 14 of the rubber mat 13 to be brought in contact with the fixed contact 15*a* of the printed circuit board 15. Thus, the switch is turned ON and the circuit is brought into conduction, thereby unlocking the door.

Thus, the circuit for locking and unlocking the door by turning the door lock switch ON is installed outside. For safety, the slider 2 is positioned back in the neutral position to set the door lock switch in the neutral position as shown in FIG. 1 when the door lock switch is not in use.

Figure 6:
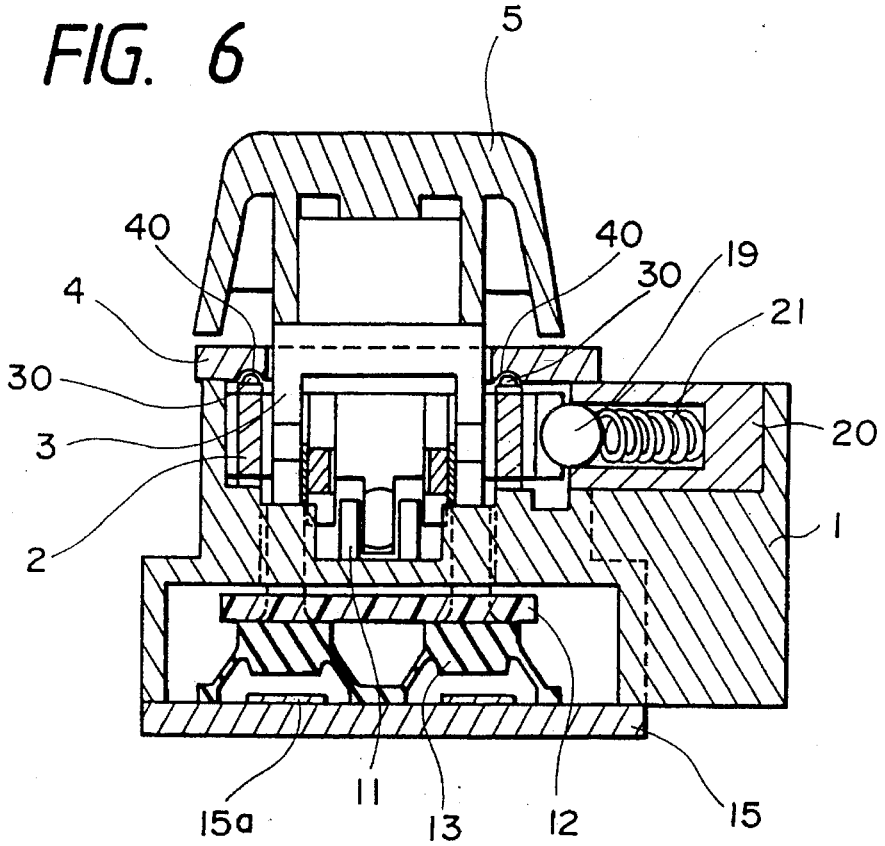
FIG. 6 is a side cross-sectional view showing a section in the vicinity of a lever shaft of another embodiment, wherein the automotive door lock switch of the present invention is applied, when the embodiment is in a neutral condition.
Figure 7:
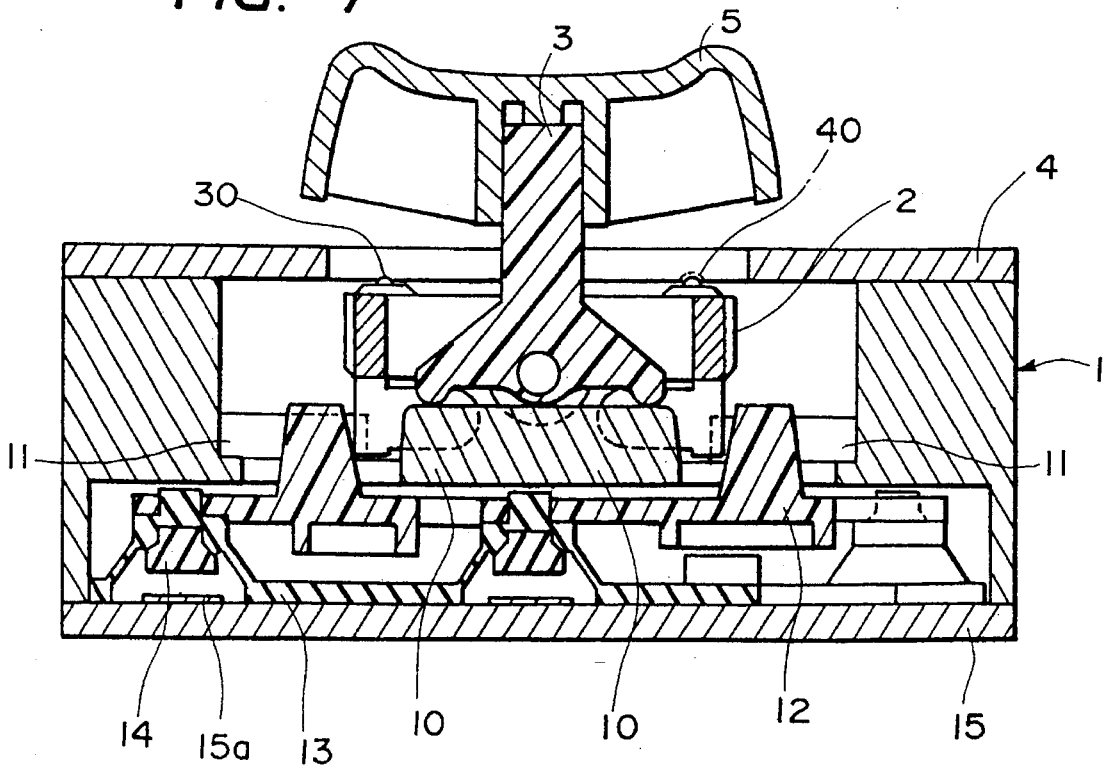
FIG. 7 is a front cross-sectional view of a section in the vicinity of a contact when the automotive door lock switch of the embodiment in FIG. 6 is in a neutral position.
Figure 8:
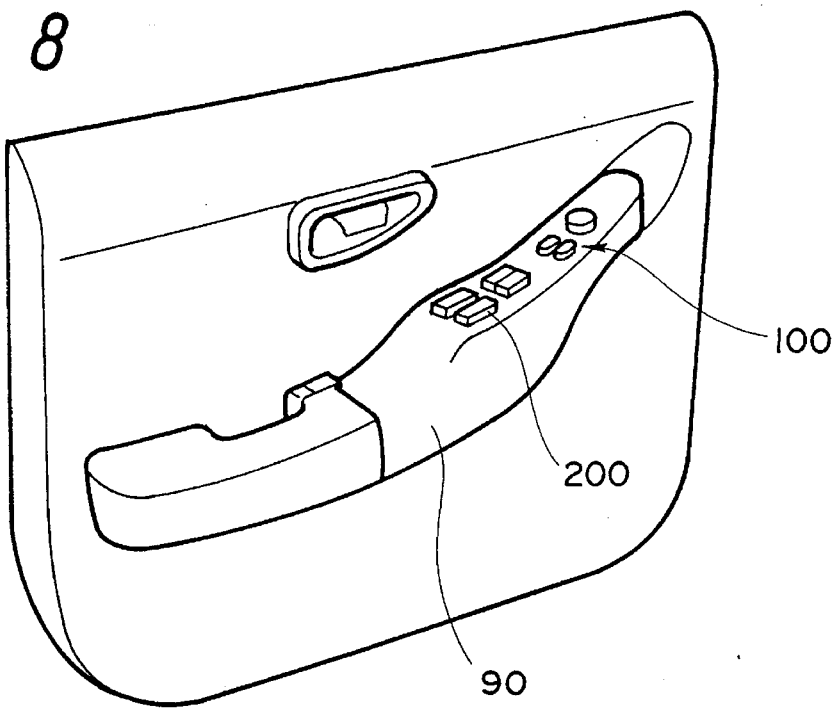
FIG. 8 is a diagram illustrative of automotive switches in use.
Figure 9:
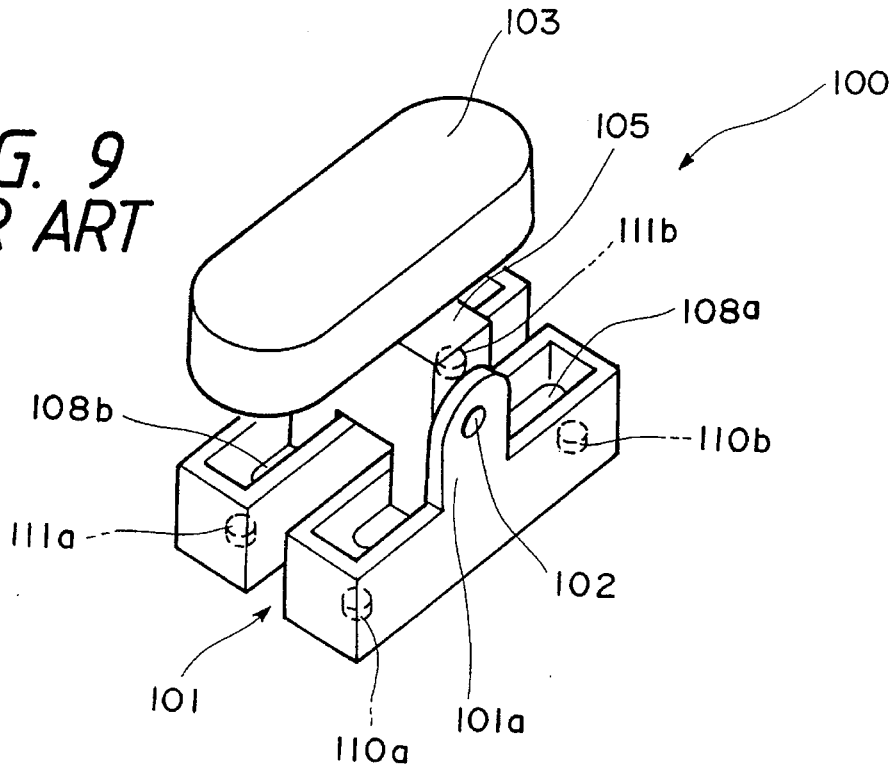
FIG. 9 PRIOR ART
FIG. 9 is a perspective view of a conventional automotive switch.

Another embodiment of the automotive door lock switch according to the present invention will now be described with reference to FIG. 6 and FIG. 7. The description of the same components as those of the embodiment stated above will be omitted.

In this embodiment, the knob 5 is always urged upward by a spring, not shown, in relation to the case 1 in the neutral state illustrated in FIG. 1. The top surface of the slider 2 is provided with a convex section 30 and the inner wall of the cover 4 is provided with a concave section 40 which engages with the convex section 30. This structure prevents the slider 2 from moving even if the knob 5 is accidentally touched in the neutral state. The knob 5 must be lightly pushed down from right above the case 1 to release the lock. After unlocking, the same series of operations as that of the previous embodiment is taken.

In other words, the previous embodiment employs a 2-step operation mechanism while this embodiment employs a 3-step operation mechanism which has an additional step for unlocking. This means that the second embodiment is characterized by the construction which ensures further reliable prevention of unintentional operation of the door lock switch.

Thus, the automotive door lock switch having the structures described above eliminates the danger of the switch being operated to lock the door even if the door lock switch provided on the armrest of the driver's seat is unintentionally touched. This feature is especially useful when the door lock switch is located near a power window switch because of a limited installing space.

When a driver tries to take a quick action to open a window while driving, he can immediately and securely distinguish the door lock switch from the power window switch even if they look alike since the door lock switch cannot be operated in its neutral position. Hence, the door lock switch according to the present invention protects a driver from unintentionally unlocking the door by pushing the door lock switch by mistake when he intended to push the power window switch while driving. This mechanism is particularly effective when the door lock switch is mounted close to a power window switch due to a limited mounting space. Likewise, the mechanism releases a driver from the danger of getting his fingers caught in the window by unintentionally pushing the power window switch and closing the window when he intended to unlock the door when getting off the car. Further, the door lock switch with such a construction prevents an extremely dangerous condition resulting from a driver's finger accidentally hitting and operating the door lock switch.

Hence, according to the present invention, a door lock switch can be securely operated exactly as the user of the door lock switch intends, since the switch cannot be operated by unintentional operation or by accidental hit by a finger or hand.

What is claimed is:

1. A switch, comprising:

a case provided with an opening, the case including a raised guide portion and a recessed portion;

a slider housed in the case;

a control lever which is rotatably supported by the slider, the control lever including an actuating portion extending through the opening of the case, the control lever also including a protrusion;

a fixed contact mounted in the case;

a movable contact movably positioned over the fixed contact;

a knob mounted on a portion of the control lever extending through the opening of the case;

a projection provided on the control lever;

holes formed in the case adacent ends of the case guide; and a cam having a base portion mounted over the movable contact, and a raised portion jutting through the holes;

wherein the slider is slidable along the case guide until the projection comes in contact with the raised portion of the cam, and subsequent rotation of the control lever causes the base portion of the cam to move downward, thereby causing the moving contact to press against the fixed contact.

2. A switch, comprising:

a case provided with an opening, the case including a guide portion;

a fixed contact mounted in the case;

a movable contact movably positioned adjacent the fixed contact;

a slider mounted in the case, the slider being movable in a first direction;

a control lever mounted on the slider, the control lever including an actuating portion extending through the opening of the case, the control lever also including a protrusion;

wherein, when the slider is in a first position, the protrusion of the control lever abuts the guide portion such that pivoting of the control lever relative to the slider is prevented by contact between the protrusion and the guide portion; and wherein, when the slider is moved in the first direction from the first position to a second position, the protrusion is displaced from the guide portion and the control lever is pivotable relative to the slider such that subsequent pivoting of the control lever causes the protrusion to push the movable contact against the fixed contact.

3. A switch according to claim 2, wherein the movable contact is mounted on a resilient rubber sheet having a domed portion, the movable contact being mounted on an inner surface of the domed portion, and wherein the switch further comprises:

a cam member disposed over the domed portion, the cam member including a projection disposed adjacent the guide portion;

wherein when the slider is in the second position, the protrusion of the control lever abuts the projection of the cam such that pivoting of the control lever pushes the cam toward the domed portion of the rubber sheet, thereby collapsing the domed portion and causing the movable contact to contact the fixed contact.

4. A switch according to claim 2, wherein the fixed contact is formed on a printed circuit board which is mounted on an outer frame of the case, and the movable contact is mounted on an interior surface of a rubber sheet formed such that the movable contact is resiliently positioned over the fixed contact.

5. A switch according to claim 2, wherein the slider includes a locking member including first and second projections defining a groove therebetween, and the switch further comprises a ball biased against the locking member such that when the slider is in the first position, the ball is biased into the groove.

6. A switch according to claim 5, further comprising a cover mounted over the case, the cover defining a slot having a length extending in the first direction, wherein the actuating portion of the control lever extends through the slot.

7. A switch according to claim 6, further comprising a knob mounted on the actuating portion of the control member, the knob being located outside of the case.

8. A switch according to claim 7, wherein the cover includes a concave section formed on an interior surface thereof, wherein the slider includes a convex section extending toward the interior surface of the cover, and wherein, when the slider is in the first position, the convex section is biased into the concave section.

* * * * *